US007498919B2

(12) United States Patent
Fujiwara et al.

(10) Patent No.: US 7,498,919 B2
(45) Date of Patent: Mar. 3, 2009

(54) THIN FILM DEVICE

(75) Inventors: Toshiyasu Fujiwara, Tokyo (JP); Kyung-Ku Choi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/723,128

(22) Filed: Mar. 16, 2007

(65) Prior Publication Data

US 2007/0222550 A1 Sep. 27, 2007

(30) Foreign Application Priority Data

Mar. 27, 2006 (JP) ..... 2006-086079

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 5,065,270 A * 11/1991 Koyanagi et al. ..... 360/123.41
5,396,212 A * 3/1995 Hernandez et al. ..... 336/223
6,185,068 B1 * 2/2001 Fujita et al. ..... 360/123.41
6,976,300 B2 * 12/2005 Ahn et al. ..... 29/604
7,176,772 B2 * 2/2007 Maeda et al. ..... 336/200
2001/0024739 A1 * 9/2001 Mizoguchi et al. ..... 428/692
2005/0174208 A1 * 8/2005 Sato et al. ..... 336/200
2005/0179514 A1 * 8/2005 Yamamoto et al. ..... 336/200

FOREIGN PATENT DOCUMENTS

JP A 5-29146 2/1993
JP A 2004-296816 10/2004

* cited by examiner

*Primary Examiner*—Anh T Mai
(74) *Attorney, Agent, or Firm*—Oliff & Berridge, PLC

(57) ABSTRACT

A thin film device, which can maintain desirable performance characteristics by reducing parasitic capacitance and increasing the Q factor even when a thin film coil of a solenoid type is equipped, is provided. The thin film coil of a solenoid type has a cross sectional width which varies with position along a film thickness direction.

11 Claims, 10 Drawing Sheets

THIN FILM DEVICE

BACKGROUND OF THE INVENTION

1. Field of the Invention

The present invention relates to a thin film device provided with a thin film coil of a solenoid type.

2. Description of the Related Art

In recent years, a thin film device including a thin film coil of a solenoid type is widely used in the electronic equipment field of various applications. One example of such thin film devices includes a thin film inductor, which is a circuit element having inductance (for example, reference to Patent Documents 1, 2). The thin film inductor has such an advantage that inductance value can be increased compared with a case where a spiral thin film coil is used.

[Patent Document 1]

Japanese Laid-Open Patent Publication (Kokai) No. H05-029146

[Patent Document 2]

Japanese Laid-Open Patent Publication No. 2004-296816

In the thin film devices represented by the foregoing thin film inductor, it is necessary to reduce parasitic capacitance generated in the thin film coils in order to set up a frequency band, which is usable as operating frequency, to a higher range. If parasitic capacitance is large, resonance frequency will fall and the Q factor will decrease. The "Q factor" is a numeric value for quantitatively indicating a performance of coils mounted in a resonance circuit and so on, generally expressed with a definitional equation $Q=\omega L/R$. Here, $\omega$, L, and R respectively represent an angular velocity, inductance, and resistance at a frequency applied.

SUMMARY OF THE INVENTION

Even though thin film devices in the past, which are provided with a thin film coil of a solenoid type, have an advantage in the viewpoint of electrical characteristics such as inductance, they may possibly have a problem in the viewpoint of performance characteristics such as operating frequency and the Q factor, depending on the magnitude of parasitic capacitance.

The present invention has been devised in view of the above problem, and it is desirable to provide a thin film device which can maintain desirable performance characteristics by reducing parasitic capacitance and increasing the Q factor even when a thin film coil of a solenoid type is provided.

A first thin film device of the present invention includes a thin film coil of a solenoid type, with its cross sectional width which varies with position along a film thickness direction. A second thin film device of the present invention includes a thin film coil of a solenoid type, with an space of its coil turns which varies with position along a film thickness direction. Further, a third thin film device of the present invention includes a thin film coil of a solenoid type, with its cross section having a shape in which a side-edge of a cross section of a turn is non-parallel to a side-edge of a cross section of an adjacent turn. The thin film device with such configuration can reduce parasitic capacitance generated in the coil turns so as to improve the Q factor compared with a case where the cross sectional width or the space between the coil turns of the thin film coil is uniform in the film thickness direction.

In the first thin film device of the present invention, it is preferred that the cross sectional width thereof is narrowed at one end or both ends, in the film thickness direction, of a cross section of the thin film coil.

It is also preferred that the first thin film device of the present invention further includes a substrate supporting the thin film coil, and the thin film coil has a plurality of first coil portions arranged in a layer closer to the substrate; a plurality of second coil portions arranged in a layer away from the substrate; and a plurality of third coil portions connecting the first and second coil portions so that the first, second and third coil portions are combined together in series to form the thin film coil. Here, the cross sectional width of at least one of the first and second coil portions is narrowed at one end, facing the other coil portion, in the film thickness direction. The thin film device with such configuration can reduce the parasitic capacitance produced between the first and second coil portions. In this case, it is preferred that one end or the other end in the longitudinal direction of the second coil portion is located so as to overlap with one end or the other end in the longitudinal direction of the first coil portion, and that the third coil portion is arranged in a position where the second coil portion overlaps with the first coil portion.

In addition, it is preferred that the first thin film device of the present invention includes: a substrate supporting the thin film coil; and at least one of a first, a second and a third magnetic film, the first magnetic film being wound with the thin film coil, the second magnetic film being arranged on a substrate-side of the thin film coil, and a third magnetic film being arranged on an opposite-side of the thin film coil from the substrate. Here, the cross sectional width of the thin film coil is narrowed at one end, facing the first, second or third magnetic film in the film thickness direction. The thin film device with such configuration can reduce the parasitic capacitance (capacity which is electromagnetically coupled via each of the magnetic films) produced between the thin film coil and each of the magnetic films, even when the first through the third magnetic films are provided.

The first thin film device of the present invention may further include a substrate supporting the thin film coil, and the thin film coil may include: a plurality of first coil portions arranged in a layer closer to the substrate; a plurality of second coil portions arranged in a layer far from the substrate; and a plurality of third coil portions connecting the first and second coil portions so that the first, second and third coil portions are combined together in series to form the thin film coil. Here, the cross sectional width of at least one of the first and second coil portion is narrower at a part closer to the substrate rather than at a part away from the substrate. The thin film device with such configuration can reduce the parasitic capacitance produced between the coil turns compared with a case where the coil width of both of the first and second coil portions are uniform, because the narrowed portions of at least one of the first and second coil portions increase their mutual distance in the coil turns. In this case, it is preferred that the cross sectional width of the first coil portion is uniform along a film thickness direction, and the cross sectional width of the second coil portion at a part closer to the substrate is narrower than that at a part away from the substrate, and is narrower than the cross sectional width of the first coil portion. Especially, it is preferred that the cross section of at least one of the first and second coil portions is mushroom-shaped. In addition, at least one of a first and a second magnetic films, the first magnetic film being wound with the thin film coil, and the second magnetic film being arranged on a substrate-side of the thin film coil may be provided. The thin film device with such configuration can reduce the parasitic capacitance produced between the thin film coil and each of the magnetic films even when the first and second magnetic films are provided. Incidentally, "mushroom-shaped" represents a configuration in which a portion far from the substrate has a uniform width, and a portion closer to the substrate has another uniform width narrower than that of the portion far from the substrate (that is, approximately T-shaped). On the other hand, "uniform width" does not necessarily mean a strictly uniform width but may include some error (that is, approximately uniform).

As for the second thin film device of the present invention, it is preferred that an space between coil turns of a thin film coil of a solenoid type is widened at one end or both ends, in the film thickness direction, of the coil turn.

EFFECTS OF THE INVENTION

According to the first through third aspects of the present invention, the thin film device is provided with a thin film coil of a solenoid type, and the cross sectional width and the space between coil turns of the thin film coil vary with position along a film thickness direction, or a cross section of the thin film coil having a shape in which a side-edge of a cross section of a turn is non-parallel to a side-edge of a cross section of an adjacent turn. As a result, parasitic capacitance produced between the coil turns is reduced. Therefore, resonance frequency increases and the Q factor improves in a high frequency region because of the reduced parasitic capacitance even when the solenoid thin film coil is provided. Accordingly, desirable performance characteristics can be secured.

Especially, in the first thin film device of the present invention, the thin film coil includes a plurality of first coil portions arranged in a layer closer to a substrate and a plurality of second coil portions arranged in a layer away from the substrate, and the cross sectional width of at least one of the first and second coil portions is narrowed at one end, facing the other coil portion, in the film thickness direction. With such configuration, the parasitic capacitance produced between the first and the second coil portions can be reduced. If the thin film device includes at least one of a first magnetic film which is wound with the thin film coil, a second magnetic film which is arranged on a side closer to the substrate as compared with the thin film coil, and a third magnetic film which is arranged on a side away from the substrate as compared with the thin film coil, and if the cross sectional width of the thin film coil is narrowed at one end on a side closer to at least one of the first through third magnetic films, the parasitic capacitance produced between the thin film coil and each of the magnetic films can be reduced. In addition, if the thin film coil includes the plurality of first coil portions arranged in a layer closer to the substrate and the plurality of second coil portions arranged in a layer away from the substrate, and if at least one of the first and second coil portions has a cross sectional width which is narrowed at a portion closer to the substrate compared with a portion away from the substrate, the parasitic capacitance produced between the coil turns of at least one of the first and second coil portions can be reduced. In this case, if the thin film device includes at least one of the first magnetic film which is wound with the thin film coil and the second magnetic film arranged on a side closer to the substrate as compared with the thin film coil, then the parasitic capacitance produced between the thin film coil and each of the magnetic films can be reduced.

Other and further objects, features and advantages of the invention will appear more fully from the following description.

DESCRIPTION OF THE PREFERRED EMBODIMENTS

Embodiments of the present invention will be described in detail hereinbelow with reference to the drawings.

First Embodiment

Figure 1:
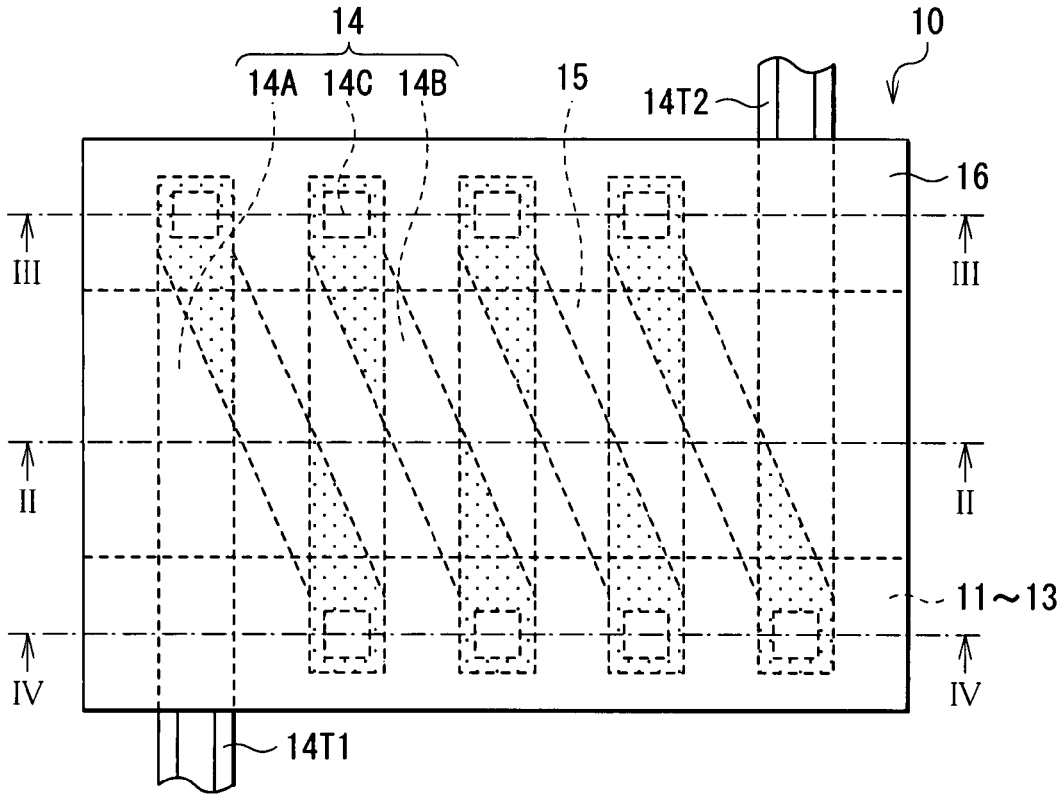
FIG. 1 is a top view showing a top view configuration of a thin film inductor as one application of a thin film device according to a first embodiment of the present invention.
Figure 2:
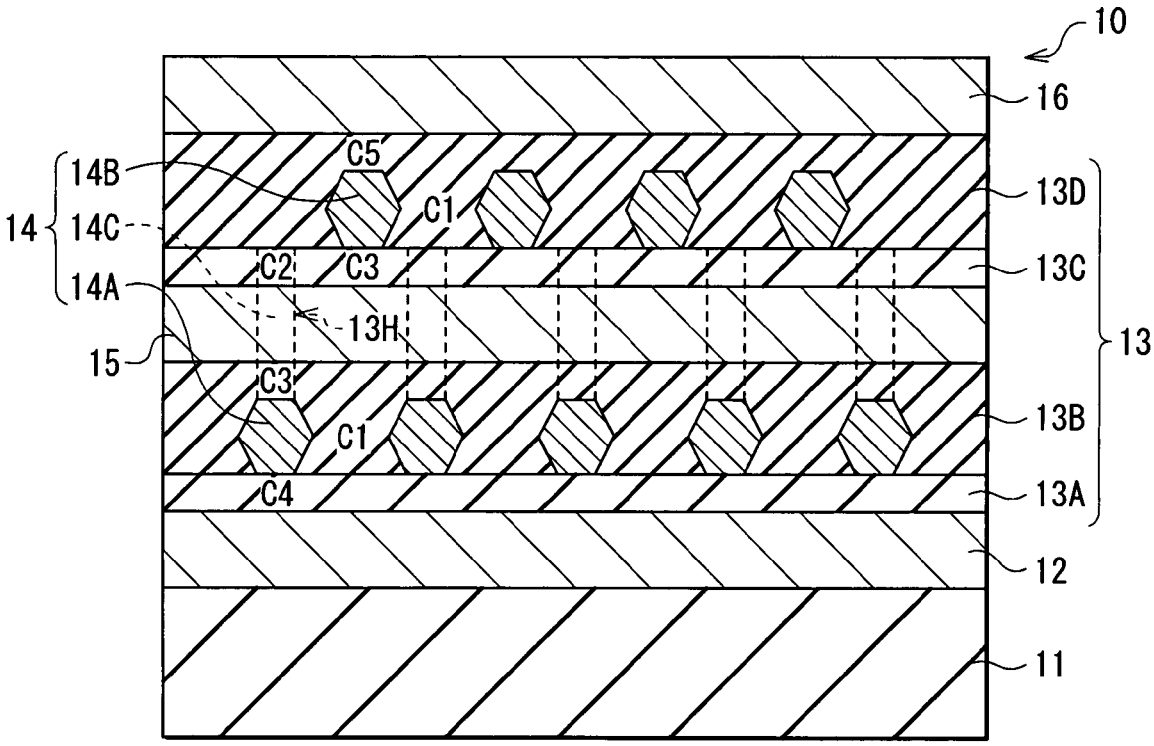
FIG. 2 is a sectional view showing a cross-sectional configuration of the thin film inductor taken along line II-II of FIG. 1.
Figure 3:
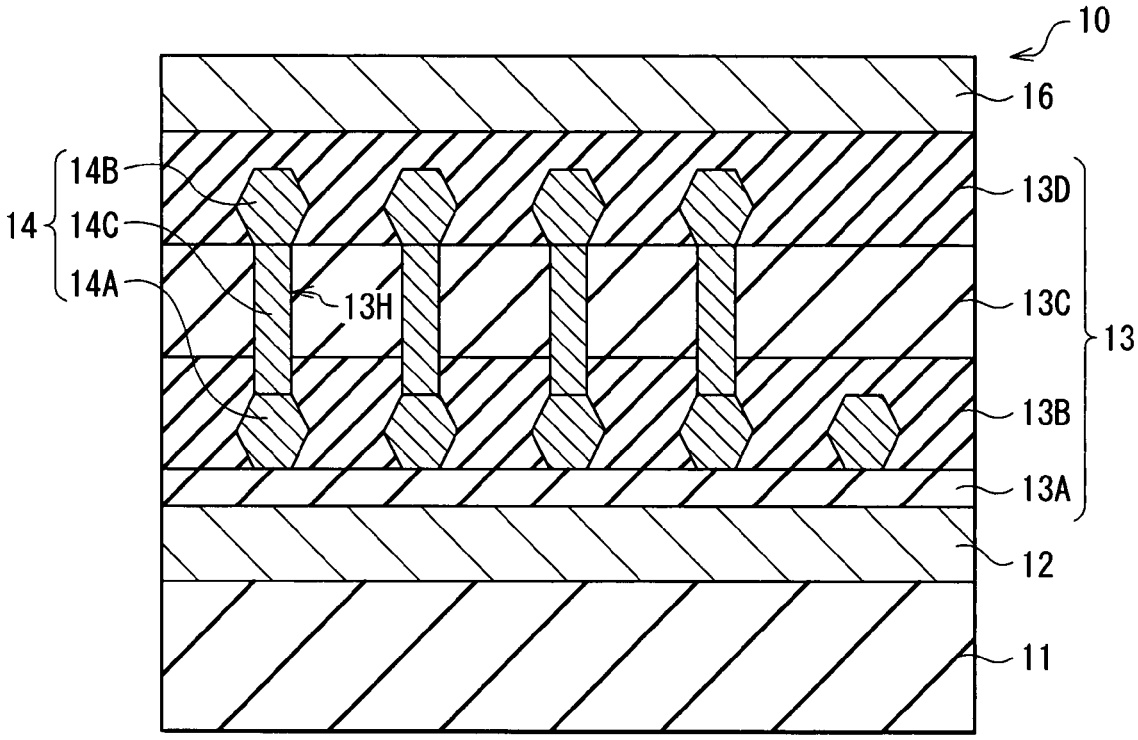
FIG. 3 is a sectional view showing a cross-sectional configuration of the thin film inductor taken along line III-III of FIG. 1.
Figure 4:
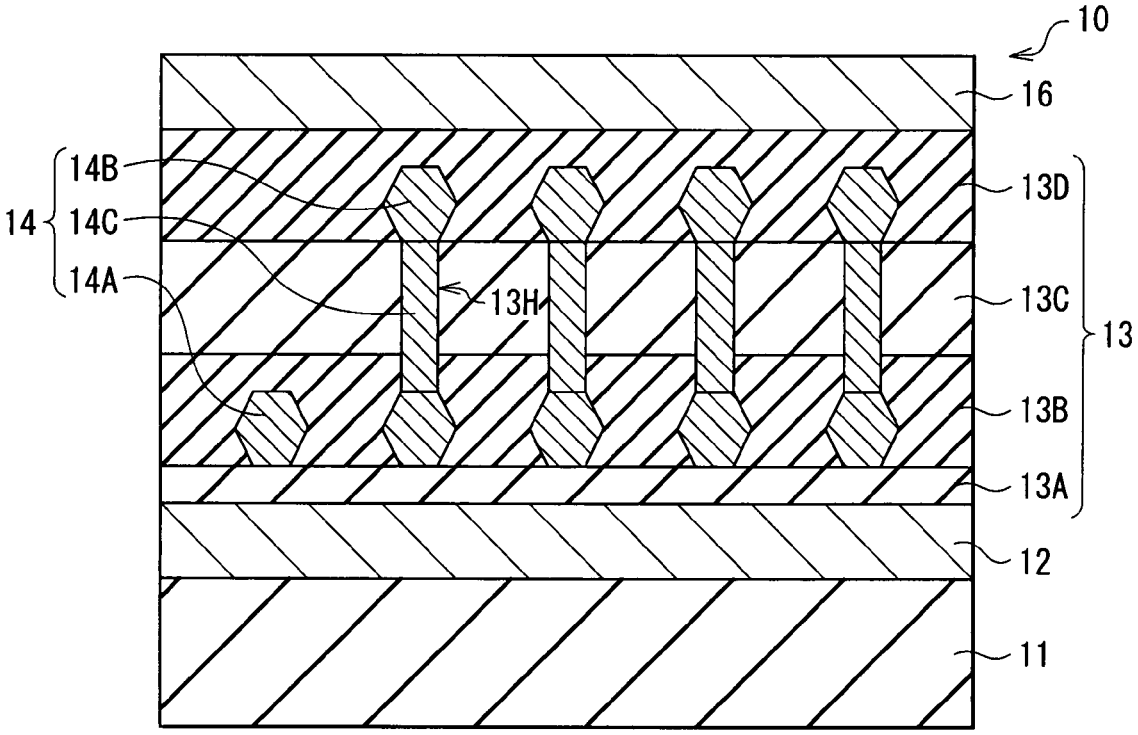
FIG. 4 is a sectional view showing a cross-sectional configuration of the thin film inductor taken along line IV-IV of FIG. 1.
Figure 5:
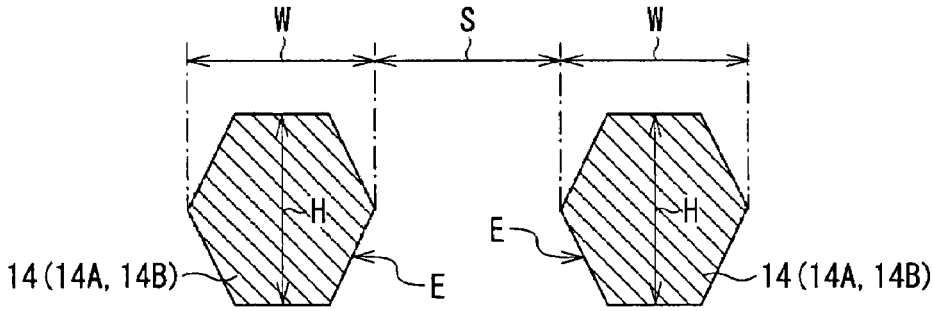
FIG. 5 is an enlarged sectional view showing an enlarged cross-sectional configuration of a part of the thin film coil illustrated in FIG. 2.

FIGS. 1 through 5 show a construction of a thin film inductor 10 as one application of a thin film device according to a first embodiment of the present invention, and, FIG. 1 illustrates a top view construction and FIGS. 2 through 5 illustrate a cross-sectional configuration thereof respectively. Here, FIGS. 2 through 4 show a cross section taken along the lines II-II, III-III, and IV-IV appearing in FIG. 1 respectively, and FIG. 5 illustrates a part of enlarged portion (two coil turns) of a thin film coil 14 shown in FIG. 2.

In the description below, it is to be noted that a side closer to a substrate 11 which is shown in FIG. 1 is called "lower" and a side away from the substrate 11 is called "upper" respectively.

The thin film inductor 10 is, as shown in FIGS. 1 to 4, constituted in such a manner that a lower magnetic film 12, a solenoid thin film coil 14 buried in an insulating film 13, a middle magnetic film 15 and an upper magnetic film 16 are layered in this order on the substrate 11.

The substrate 11 is a support base supporting the thin film coil 14 and so on, which is formed by, for example, glass, silicon (Si), aluminum oxide ($Al_2O_3$; what is called alumina), ceramics, ferrite, semiconductor or resin. It is to be noted that the component materials of the substrate 11 are not necessarily limited to the above mentioned series of materials, but can be optionally selectable.

Each of the lower magnetic film 12 (a second magnetic film), the middle magnetic film 15 (a first magnetic film), and the upper magnetic film 16 (a third magnetic film), which has a function of increasing inductance, is formed by, for example, conductive magnetic materials such as a Co-based alloy, Fe-based alloy or NiFe-based alloy, or insulating magnetic materials such as ferrite. Examples of the Co-based alloy include a cobalt zirconium tantalum (CoZrTa)-based alloy or a cobalt zirconium niobium (CoZrNb)-based alloy. It is to be noted that the component materials of the series of magnetic films 12, 15, and 16 are not necessarily identical to each other but can be set up individually.

The thin film coil 14, which constitutes an inductor between one end (terminal 14T1) and the other end (terminal 14T2), is formed by conductive materials such as Cu. The thin film coil 14, which is arranged so as to wind around the middle magnetic film 15, includes a plurality of lower coil portions 14A (a first coil portion) of a thin strip-shape arranged on a layer closer to the substrate 11 (lower layer), a plurality of upper coil portions 14B (a second coil portion) arranged on a layer away from the substrate 11 (upper layer), and a plurality of pillar-shaped intermediate coil portions 14C (a third coil portion) arranged between the lower layer and the upper layer so as to connect the lower coil portions 14A and the upper coil portions 14B in series. Here, for example, the plurality of the upper coil portions 14B are arranged so as to overlap with one end or the other end of the plurality of lower coil portions 14A, and the intermediate coil portions 14C are arranged in the position where the lower coil portions 14A and the upper coil portions 14B overlap each other. In FIG. 1, the area where the lower coil portions 14A and the upper coil portions 14B are overlapped each other is covered with half-tone dot meshing.

As shown in FIG. 5, a cross sectional width W of the thin film coil 14 varies in its film thickness direction (up-and-down direction). In this case, it is preferred that side ends E, at which the cross sections of the thin film coil 14 are adjoined each other between the coil turns, are not non-parallel because a gap S between the coil turns of the thin film coil 14 varies in its film thickness direction. Especially, it is preferred that the cross sectional width W of at least one of the lower coil portions 14A or the upper coil portions 14B is narrowed at one end, facing the other coil portion, in the film thickness direction, and is also narrowed at one end, facing the lower magnetic film 12, the middle magnetic film 15 or the upper magnetic film 16, in the film thickness direction.

Here, each cross section of the lower coil portions 14A and the upper coil portions 14B has the shape of a hexagon (with a height of H), for example. Accordingly, the cross sectional width W of both of the lower coil portions 14A and the upper coil portions 14B is narrowed at the both ends thereof in the film thickness direction (that is, at the bottom and the top end). Namely, the cross sectional widths W of both of the lower coil portions 14A and the upper coil portions 14B are narrowed at one ends thereof on a side facing each other (that is, at the top end of the lower coil portions 14A and the bottom end of the upper coil portions 14B), and are narrowed at the ends closer to the lower magnetic film 12, the middle magnetic film 15 and the upper magnetic film 16 (at the bottom and top ends of the lower coil portions 14A and the upper coil portions 14B). In addition, the gap S of the coil turns for both of the lower coil portions 14A and the upper coil portions 14B is widened at the both ends in the film thickness direction.

Incidentally, in the case of FIG. 5, the configuration of the cross section of the intermediate coil portions 14C can be set up arbitrarily. For example, although FIG. 1 shows a case where the cross section of the intermediate coil portion 14C has the shape of a rectangle, it may be the same as that of the lower coil portions 14A and upper coil portions 14B.

FIG. 2 shows a parasitic capacitance of each portion, which contributes to the whole parasitic capacitance of the thin film inductor 10. "C1" represents a parasitic capacitance generated in the coil turns between the thin film coil 14 (the lower coil portion 14A, the upper coil portions 14B), "C2" represents a parasitic capacitance generated between the lower coil portions 14A and the upper coil portions 14B, "C3" represents that between the thin film coil 14 and the middle magnetic film 15, "C4" represents that between the thin film coil 14 (the lower coil portions 14A) and the lower magnetic film 12, and "C5" represents that between the thin film coil 14 (the upper coil portions 14B) and the upper magnetic film 16 respectively.

The insulating film 13, which electrically separates the thin film coil 14 from the lower magnetic film 12, the middle magnetic film 15, and the upper magnetic film 16, is formed by insulating nonmagnetic materials such as silicon oxide ($SiO_2$), or insulating resin materials such as polyimide or photoresist. The insulating film 13 includes, for example, a lower insulating film 13A provided over the lower magnetic film 12, a lower coil insulating film 13B provided on the lower insulating film 13A so as to bury the lower coil portions 14A, an upper insulating film 13C provided on the lower coil insulating film 13B so as to bury the middle magnetic film 15, and an upper coil insulating film 13D provided on the upper insulating film 13C so as to bury the upper coil portions 14B. The lower coil insulating film 13B and the upper insulating film 13C are provided with a contact hole 13H for every position where the lower coil portions 14A and the upper coil portions 14B are overlapped each other so that the intermediate coil portion 14C is embedded in each of the contact hole 13H. It is to be noted that component materials of the series of insulating films 13A to 13D are not necessarily identical each other, but can be set up individually.

Next, a manufacturing method of the thin film inductor 10 will be explained with reference to FIGS. 1 to 5. Hereinbelow, since the construction materials of the series of component elements have already been explained, the description thereof will be omitted.

First, after forming the lower magnetic film 12 on the substrate 11 by electroplating method or sputtering, the lower insulating film 13A is formed on the lower magnetic film 12 by sputtering or a spin coat method. Subsequently, after carrying out pattern formation of the plurality of lower coil portions 14A on the lower insulating film 13A by electroplating method or sputtering, the lower coil insulating film 13B is formed so as to bury the lower coil portions 14A by sputtering or spin coat method. Then, after carrying out pattern formation of the middle magnetic film 15 on the lower coil insulating film 13B by electroplating method or sputtering, the upper insulating film 13C is formed so as to bury the middle magnetic film 15 by sputtering or spin coat method. Subsequently, after making the plurality of contact holes 13H by selectively etching the upper insulating film 13C and the lower coil insulating film 13B by photolithography method and etching method (for example, the ion milling method), etc., the intermediate coil portion 14C is formed in each of the contact holes 13H so as to be connected with the lower coil portions 14A by electroplating method and so on. Subsequently, after carrying out pattern formation of the plurality of the upper coil portions 14B on the upper insulating film 13C so as to be connected with the intermediate coil portion 14C by electroplating or sputtering, etc., the upper coil insulating film 13D is formed so as to bury the upper coil portions 14B by sputtering or spin coat method. Finally, the upper magnetic film 16 is formed on the upper coil insulating film 13D by electroplating method or sputtering, etc. In this manner, the solenoid thin film coil 14 and the insulating film 13 are formed and fabrication of the thin film inductor 10 has been thereby completed.

According to the thin film device of the present embodiment, the cross sections of the lower coil portions 14A and the upper coil portions 14B have the shape of a hexagon. Accordingly, it is possible to maintain desirable performance characteristics by reducing parasitic capacitance to increase the Q factor for the following reasons, even when the solenoid thin film coil 14 is equipped therein.

Figure 6:
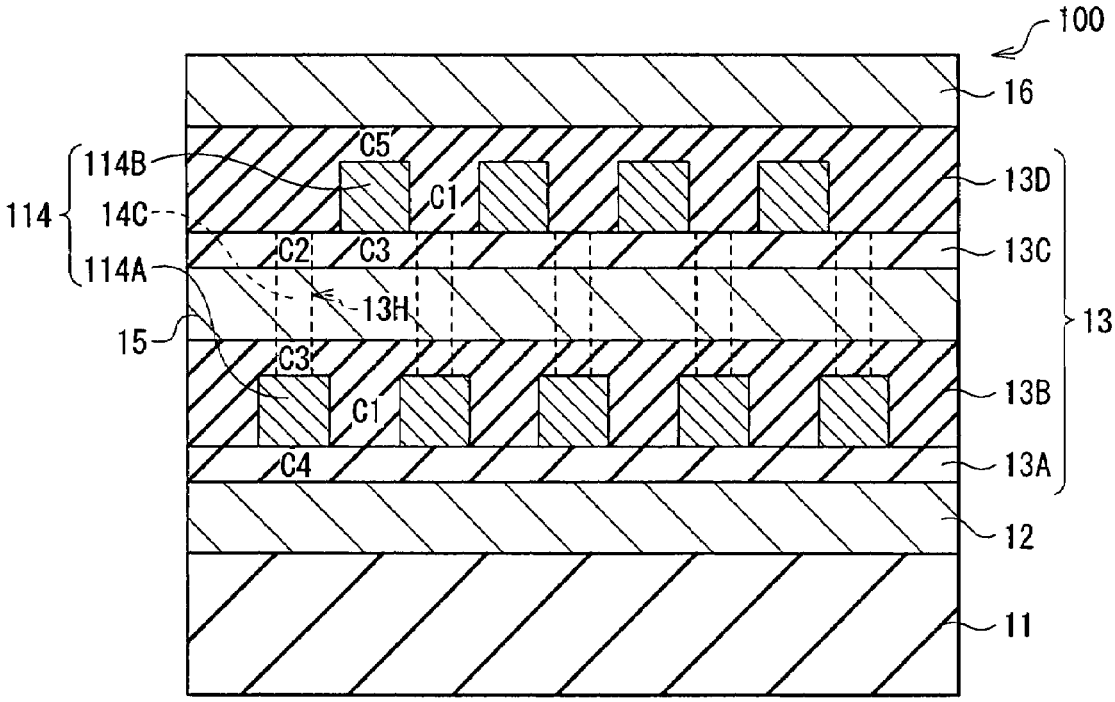
FIG. 6 RELATED ART
FIG. 6 is a sectional view showing a cross-sectional configuration of a thin film inductor as a comparative example to the thin film inductor of the present invention.
Figure 7:
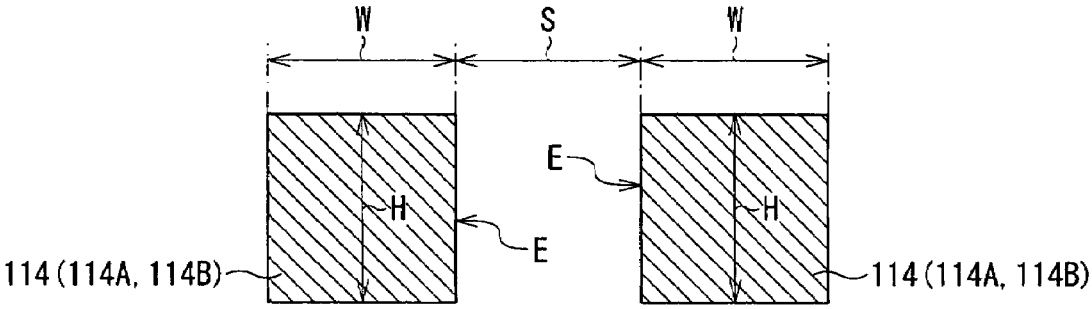
FIG. 7 RELATED ART
FIG. 7 is an enlarged sectional view showing an enlarged cross-sectional configuration of a part of the thin film coil illustrated in FIG. 6.

FIGS. 6 and 7 express a construction of a thin film inductor 100 as a comparative example to the thin film inductor 10, illustrating cross-sectional configurations thereof so as to correspond to FIGS. 2 and 5 respectively. Construction of the thin film inductor 100 is the same with that of the thin film inductor 10 except that a thin film coil 114 is provided instead of the thin film coil 14. The thin film coil 114 has, as shown in FIGS. 6 and 7, substantially the same construction as the thin film coil 14 except that the cross sections of both of the lower coil portions 114A and the upper coil portions 114B have the shape of a rectangle so that the width W and the gap S are uniform in the film thickness direction.

In the thin film inductor 100 (reference to FIGS. 6 and 7) of the comparative example, parasitic capacitance of each part, which contributes to the whole parasitic capacitance, will increase too much because of the cross-sectional configurations of the lower coil portions 114A and the upper coil portions 114B. Specifically, first, since side ends E, which are facing each other between the coil turns of the lower coil portions 114A and between the coil turns of the upper coil portions 114B, are all arranged in parallel each other in the whole area, the opposed area between the coil turns becomes the maximum, the parasitic capacitance C1 becomes the maximum. Secondly, if the width W is enlarged enough in order to reduce a direct current resistance of the thin film coil 114, the opposed area between the lower coil portion 114A and the upper coil portions 114B becomes the largest so that the parasitic capacitance C2 becomes the maximum. Thirdly, if the width W is enlarged enough as described above, the opposed area between the thin film coil 114 and the middle magnetic film 15 becomes the largest so that the parasitic capacitance C3 becomes the maximum. In this case, the opposed areas between the thin film coil 114 and the lower magnetic film 12, and between the thin film coil 114 and the upper magnetic film 16 also become the largest respectively so that the parasitic capacitances C4 and C5 also become the maximum. Accordingly, in the foregoing comparative example in the case of providing the solenoid thin film coil 114, the whole parasitic capacitance increases too much. As a result, the resonance frequency falls and the Q factor decreases in a high frequency region, so that it becomes difficult to maintain desirable performance characteristics.

In the thin film inductor 10 of the present embodiment (reference to FIGS. 1 to 5), on the other hand, the parasitic capacitance of each portion which contributes to the whole parasitic capacitance is reduced compared with the case of the comparative example based on the cross-sectional configurations of the lower coil portions 14A and the upper coil portions 14B. Specifically, first, since the side ends E, which are adjoining each other between the coil turns of the lower coil portions 114A and between the coil turns of the upper coil portions 114B, are not arranged in parallel each other in the whole area, the parasitic capacitance C1 is reduced. Secondly, even when the width W is enlarged enough in order to reduce the direct current resistance of the thin film coil 14, the opposed area between the lower coil portions 14A and the upper coil portions 14B is made smaller. As a result, the parasitic capacitance C2 is reduced. Thirdly, even when the width W is enlarged enough as described above, the opposed areas between the thin film coil 14 and the lower magnetic film 12, the middle magnetic film 15 or the upper magnetic film 16 are made smaller. As a result, the parasitic capacitances C3 to C5 are reduced. Accordingly, in the present embodiment, the whole parasitic capacitance is reduced even when the solenoid thin film coil 14 is equipped therein. As a result, the resonance frequency increases and the Q factor in a high frequency region also increases, so that it becomes possible to maintain desirable performance characteristics.

In addition, in the present embodiment as described above, the parasitic capacitances C3 to C5 are reduced even when the lower magnetic film 12, the middle magnetic film 15, and the upper magnetic film 16 are attached to the thin film coil 14. As a result, inductance can be increased as well while reducing the whole parasitic capacitance. Further, in this case, it is possible to make space between the thin film coil 14 and the lower magnetic film 12, and between the thin film coil 14 and the upper magnetic film 16 because of the reduced parasitic capacitances C4 and C5. As a result, the thin film inductor 10 can be fabricated lower and more compact while preventing the whole parasitic capacitance from increasing too much.

However, a magnetic-path structure of the thin film inductor 10 becomes more similar to that of a closed magnetic path as the space between the lower magnetic film 12 and the thin film coil 14 and between the thin film coil 14 and the upper magnetic film 16 are narrowed. As a result, there is a tendency that the inductance increases while the resonance frequency falls because of the increase of the parasitic capacitance. On the other hand, if the above-mentioned two spaces are widened, there is a tendency that the resonance frequency will increase while the inductance decreases because of the reduced parasitic capacitance. In view of the above, it is known that the inductance and the resonance frequency are in the relation of trade-off each other. Accordingly, it is preferred that the foregoing two spaces are determined in consideration of the balance between the inductance and the resonance frequency.

In addition, according to the present embodiment, the parasitic capacitance C2 may be reduced even when the cross sectional width W of the lower coil portions 14A and the upper coil portions 14B are enlarged enough as described above. As a result, the direct current resistance of the thin film coil 14 can be reduced while reducing the whole parasitic capacitance as well.

Figure 8:
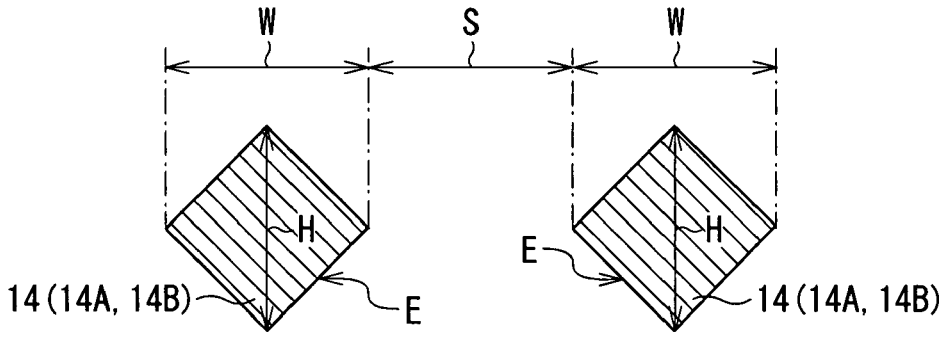
FIG. 8 is a sectional view showing a first modification with regard to a construction of the thin film inductor.

Incidentally, in the present embodiment, the cross sectional widths W of the lower coil portions 14A and the upper coil portions 14B are made narrower at the both ends thereof in the film thickness direction by forming the cross sections thereof into the shape of a hexagon, as described in FIG. 5. However, it is not necessarily limited to that. To take an example, the cross sectional configurations of the lower coil portions 14A and the upper coil portions 14B may be diamond-shaped as shown in FIG. 8, which corresponds to FIG. 5. Since all the parasitic capacitances C1 to C5 are remarkably reduced in this case, the whole parasitic capacitance can be more reduced while the Q factor can be more increased.

Figure 9:
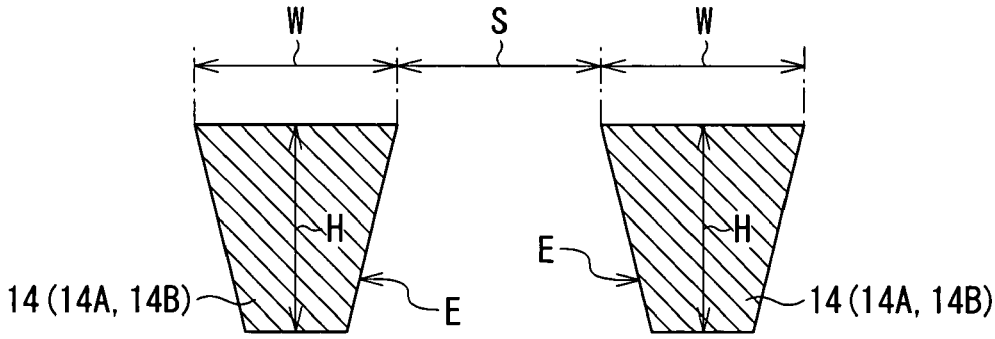
FIG. 9 is a sectional view showing a second modification with regard to a construction of the thin film inductor.
Figure 10:
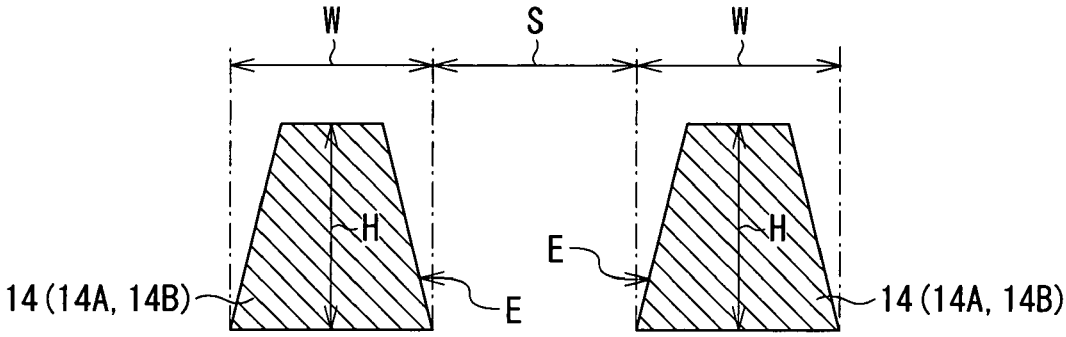
FIG. 10 is a sectional view showing a third modification with regard to a construction of the thin film inductor.

Further, in the present embodiment, the cross sectional width W of the lower coil portions 14A and the upper coil portions 14B are made narrowed at the both ends thereof in the film thickness direction as shown in FIG. 5. However, it is not necessarily limited to that and it may be made narrowed only in one end thereof in the film thickness direction. To take an example, as shown in FIGS. 9 and 10 corresponding to FIG. 5, the cross sections of the lower coil portions 14A and the upper coil portions 14B may have the shape of a trapezoid where it is tapered and narrowed toward the lower ends (that is, the lower width is smaller than the upper width) (reference to FIG. 9), or they may have the shape of a trapezoid where it is tapered and narrowed toward the upper ends (that is, the upper width is smaller than the lower width) (reference to FIG. 10). In the case of FIG. 9, the parasitic capacitances C1 to C4 are reduced as compared with the case of the comparative example. On the other hand, in the case of FIG. 10, the parasitic capacitances C1 through C3 and C5 are reduced as compared with the case of the comparative example. In either case, it is possible to reduce the whole parasitic capacitance and increase the Q factor.

Figure 11:
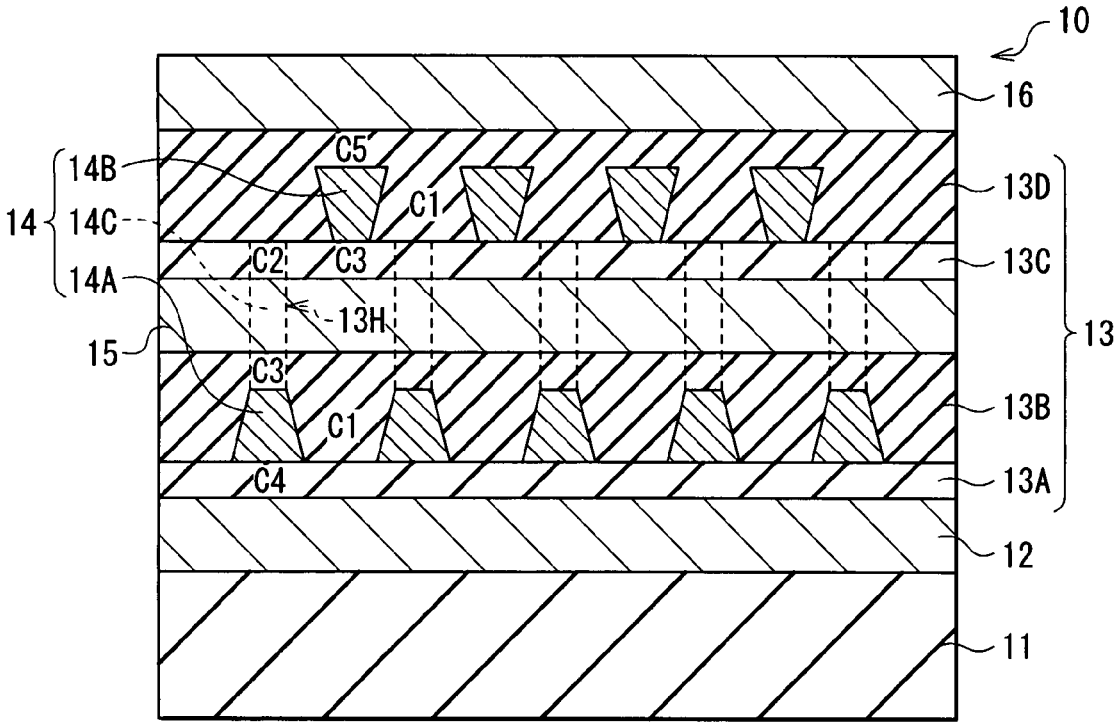
FIG. 11 is a sectional view showing a fourth modification with regard to a construction of the thin film inductor.
Figure 12:
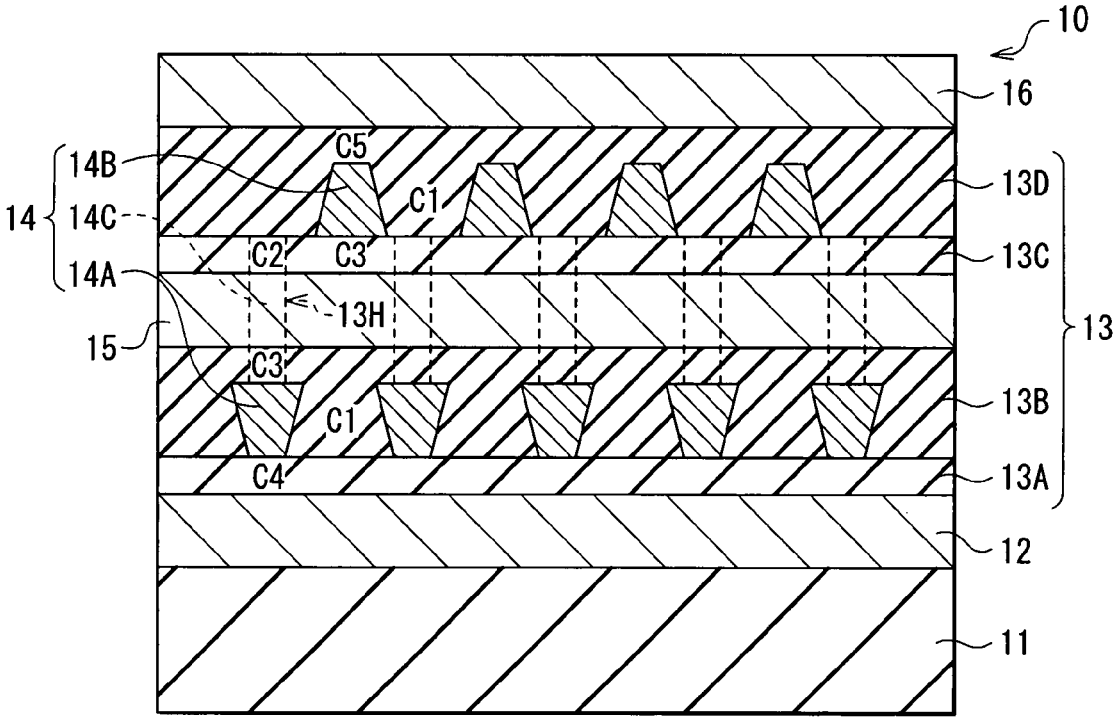
FIG. 12 is a sectional view showing a fifth modification with regard to a construction of the thin film inductor.

In addition, in the present embodiment, though the cross sectional configuration of the lower coil portions 14A and that of the upper coil portions 14B are identical to each other as shown in FIG. 2, they are not necessarily limited to that, and may have a mutually different configuration. To take an example, as shown in FIGS. 11 and 12 corresponding to FIG. 2, the thin film inductor 10 may be made in such a manner that the cross sectional configuration of the lower coil portions 14A is of the trapezoid shape shown in FIG. 10, while that of the upper coil portions 14B is of the trapezoid shape shown in FIG. 9 (reference to FIG. 11). Or, the cross sectional configuration of the lower coil portions 14A may be of the trapezoid shape shown in FIG. 9 while that of the upper coil portions 14B may be of the trapezoid shape shown in FIG. 10 (reference to FIG. 12). In the case of FIG. 11, the parasitic capacitances C1 to C3 are reduced as compared with the case of the comparative example. In the case of FIG. 12, on the other hand, the parasitic capacitances C1, C4, and C5 are reduced as compared with the case of the comparative example. In either case, it is possible to reduce the whole parasitic capacitance and increase the Q factor.

Figure 13:
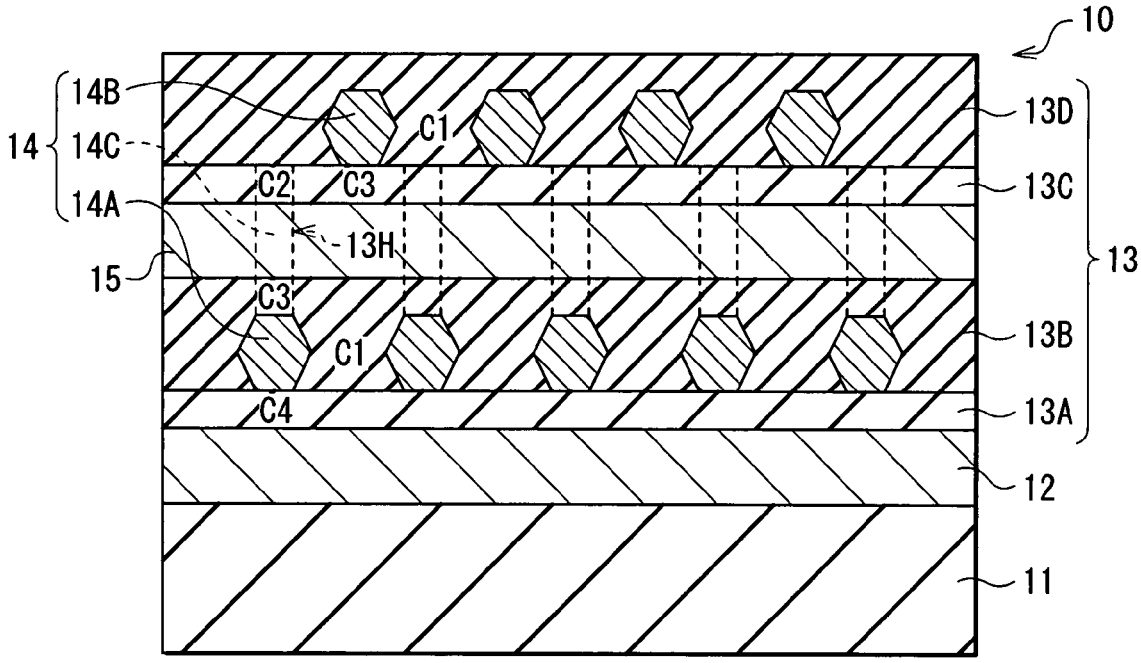
FIG. 13 is a sectional view showing a sixth modification with regard to a construction of the thin film inductor.
Figure 14:
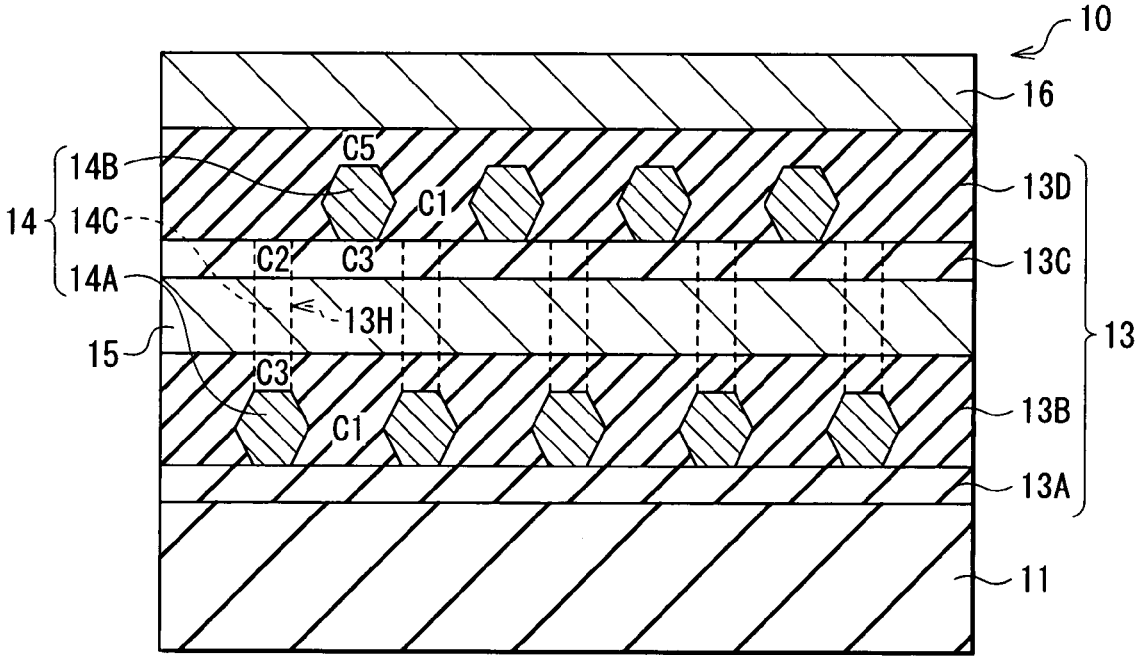
FIG. 14 is a sectional view showing a seventh modification with regard to a construction of the thin film inductor.
Figure 15:
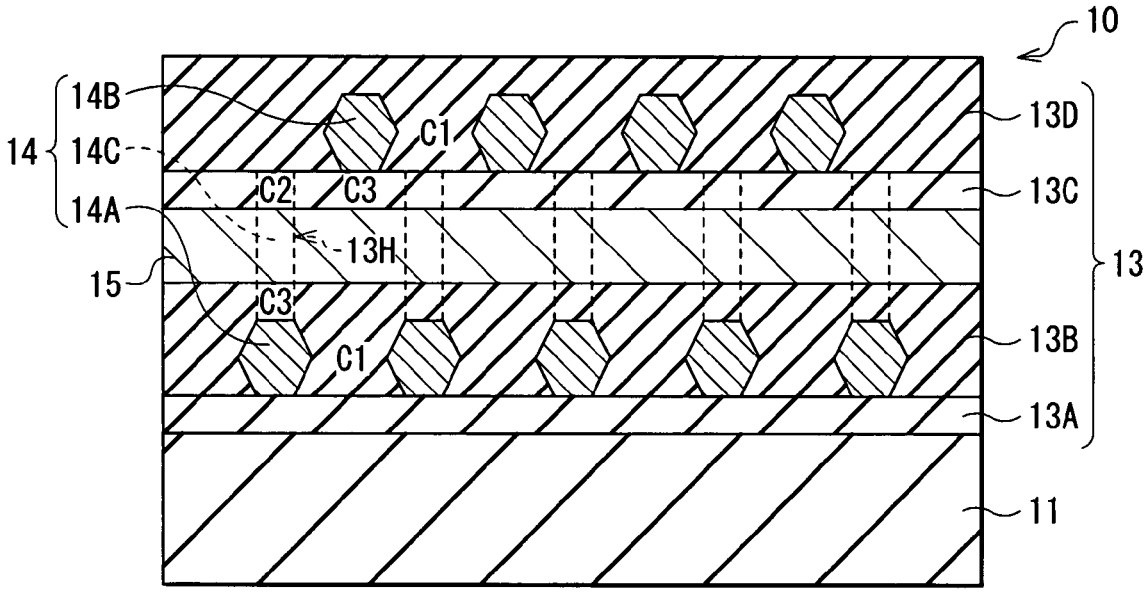
FIG. 15 is a sectional view showing an eighth modification with regard to a construction of the thin film inductor.

Further, in the present embodiment, though both of the lower magnetic film 12 and the upper magnetic film 16 are provided as shown in FIG. 2, it is not necessarily limited to that. Specifically, for example as shown in FIGS. 13 to 15 respectively corresponding to FIG. 2, only the lower magnetic film 12 may be provided without the upper magnetic film 16, (reference to FIG. 13), or only the upper magnetic film 16 may be provided without the lower magnetic film 12 (reference to FIG. 14), or neither of the lower magnetic film 12 nor the upper magnetic film 16 may be provided therein (reference to FIG. 15). In either case, it is possible to reduce the whole parasitic capacitance and increase the Q factor.

Figure 16:
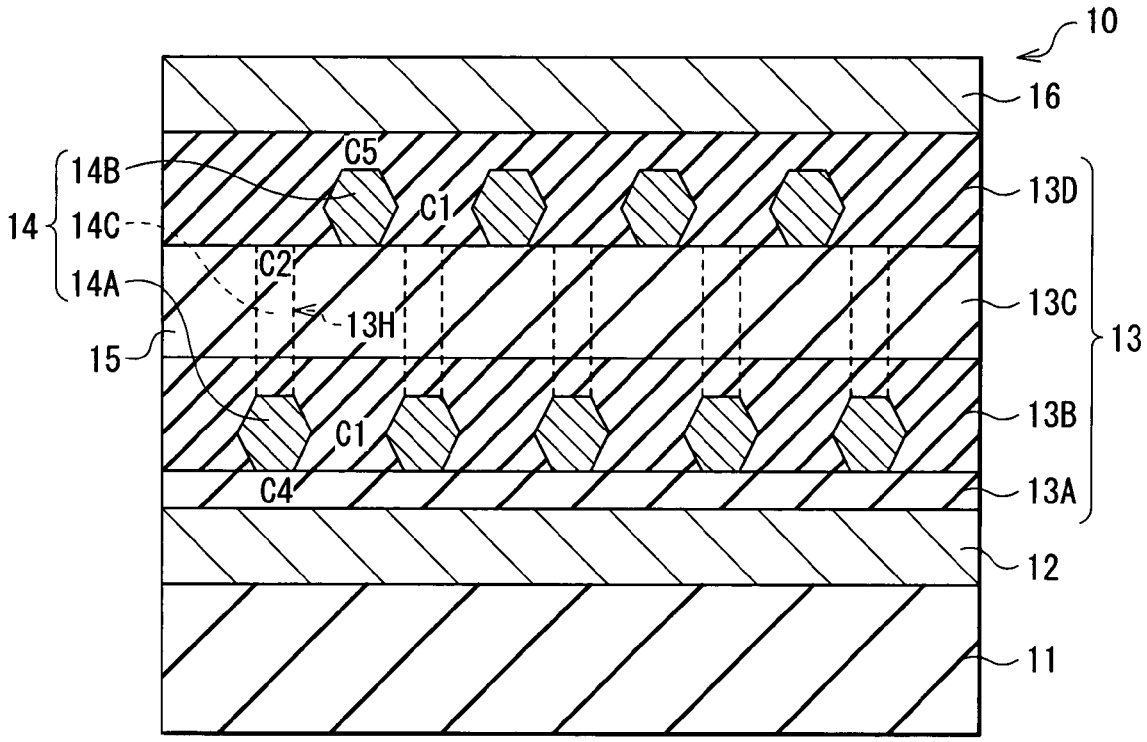
FIG. 16 is a sectional view showing a ninth modification with regard to a construction of the thin film inductor.

Further, in the present embodiment, though the middle magnetic film 15 is provided as shown in FIG. 2, it is not necessarily limited to that and the middle magnetic film 15 may not be provided. In this case, a conductive nonmagnetic material may be embedded in a field where the middle magnetic film 15 was arranged, or the upper insulating film 13C (insulating nonmagnetic material) may be embedded in a field where the middle magnetic film 15 was arranged as shown in FIG. 16 corresponding to FIG. 2. Also in this case, it is possible to reduce the whole parasitic capacitance and increase the Q factor.

In addition, in the present embodiment, though the middle magnetic film 15 and the upper insulating film 13C are embedded in a space surrounded by the thin film coil 14 as shown in FIG. 2, it is not necessarily limited to that. For example, the middle magnetic film 15 and the upper insulating film 13C may be removed from a space surrounded by the thin film coil 14 to make a hollow space, thereby turning the thin film coil 14 into what is called a hollow coil. Such a hollow coil can be fabricated by, for example, forming in advance a sacrifice layer which is dissolvable in a specified solvent etc. in the space surrounded with the thin film coil 14, then by dissolving and removing the sacrifice layer after the formation of the thin film coil 14. Also in this case, it is possible to reduce the whole parasitic capacitance and increase the Q factor.

In addition, in the present embodiment, although the cross section of the lower coil portions 14A and that of the upper coil portions 14B are of a common height H as shown in FIG. 5, it is not necessarily restricted to that. For example, in order to lower the direct current resistance of the thin film coil 14 by enlarging the cross section of the lower coil portions 14A or that of the upper coil portions 14B, the cross sectional heights H thereof may differ from each other. In this case, the height H of the upper coil portions 14B may be larger than that of the lower coil portions 14A, or that may be vice versa. With such configuration, the direct current resistance of the thin film coil 14 can be more lowered while reducing the parasitic capacitance.

However, when the height H of the lower coil portions 14A and that of the upper coil portions 14B are different from each other, it is preferred that the height H of the upper coil portion 14B is larger than that of the lower coil portion 14A in order to increase inductance, for example. Because, if the height H of the lower coil portions 14A is relatively smaller, surface smoothness of the lower coil insulating film 13B is improved compared with the case where the height H of the lower coil portions 14A is larger, thereby improving surface smoothness of the middle magnetic film 15, which contributes most to the inductance. As a result, magnetic properties (magnetic permeability) of the magnetic film 15 is hardly deteriorated.

Although the construction of the thin film coil 14 is shown in FIGS. 1 through 4 in the present embodiment, the number of turns of coils, relative location between the lower coil portions 14A and the upper coil portions 14B (range of overlapping), or a leading direction of the terminations 14T1 and 14T2 and so on are not necessarily restricted to those shown in FIGS. 1 through 4, but it can be set up arbitrarily.

Second Embodiment

Next, a second embodiment of the present invention will be described hereinbelow.

Figure 17:
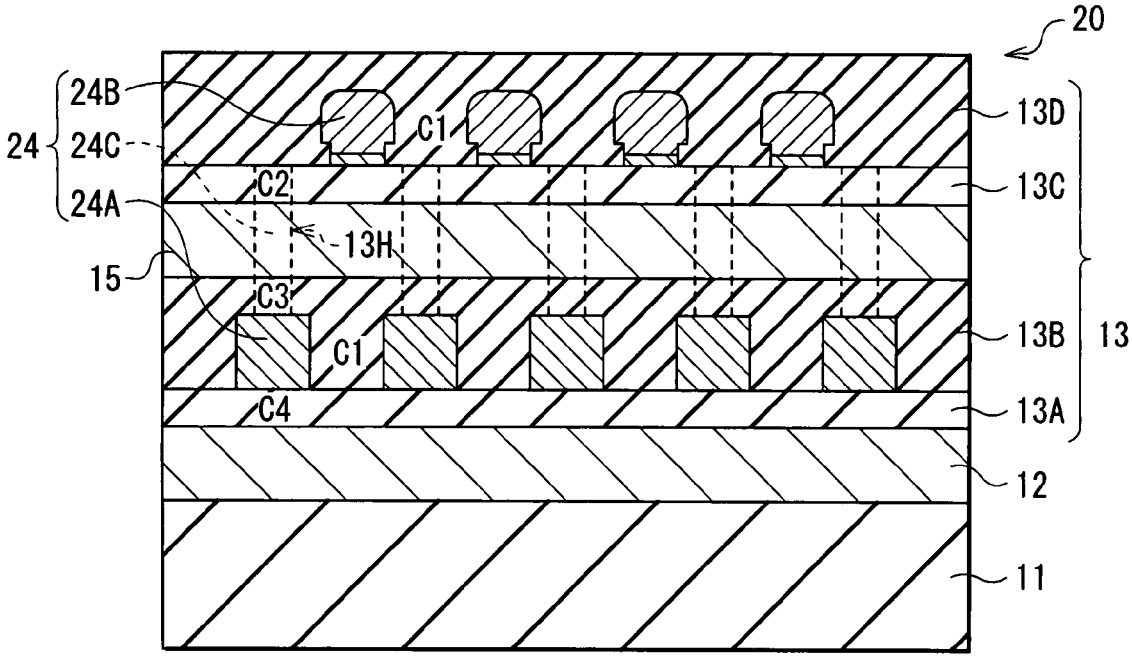
FIG. 17 is a sectional view showing a cross-sectional configuration of a thin film inductor as one application of a thin film device according to a second embodiment of the present invention.
Figure 18:
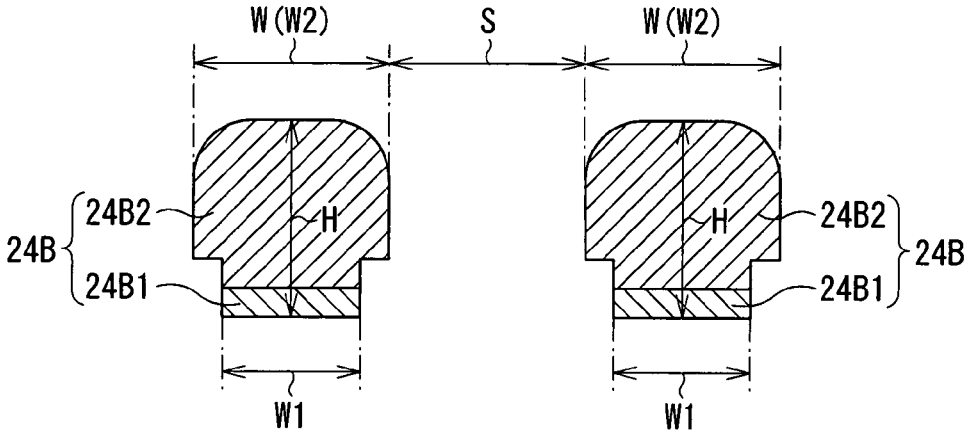
FIG. 18 is an enlarged sectional view showing an enlarged cross-sectional configuration of a part of the thin film coil illustrated in FIG. 17.

FIGS. 17 and 18 show a construction of a thin film inductor 20 as one application of a thin film device according to a second embodiment of the present invention, illustrating a cross-sectional configuration thereof respectively corresponding to FIGS. 2 and 5. In FIGS. 17 and 18, the same reference numerals are given to the same component elements as those shown in FIGS. 2 and 5.

The thin film inductor 20 has, as shown in FIGS. 17 and 18, the same configuration as that of the thin film inductor 10 described in the foregoing first embodiment except for the point that a thin film coil 24 is equipped instead of the thin film coil 14 and that the upper magnetic film 16 is not provided.

In the thin film coil 24, for example as shown in FIG. 18, the cross sectional width W of at least one of lower coil portions 24A and upper coil portions 24B varies with position along a film thickness direction. For example, here, the cross section of the lower coil portions 24A has the shape of a rectangle with a uniform cross sectional width W in the film thickness direction, and the cross sectional configuration of the upper coil portions 24B is mushroom-shaped with its cross sectional width W which varies with position along a film thickness direction. The construction of intermediate coil portions 24C is the same as that of the intermediate coil portions 14C, for example.

The lower coil portions 24A is made of a plating film which is selectively grown, for example, after forming a frame using a film photoresist, and the cross sectional height H thereof is about 50 μm or less. The width of the lower coil portions 24A is made identical to a width W2 of an after-mentioned plating film 24 B2 of the upper coil portions 24B, for example.

The width of the upper coil portions 24B is narrower in a portion closer to the substrate 11 (lower portion) than that in a portion away from the substrate 11 (upper portion). The upper coil portions 24B is formed in such a manner as to laminate, for example, a seed film 24B1 of a width W1 and a plating film 24B2 whose lower portion is of the width W1 identical to that of the seed film 24B1 and whose upper portion is of a width W2 larger than the width W1 in order from the side closer to the substrate 11. The cross sectional height H of the upper coil portions 24B is about 50 μm or more. The upper portion width W2 of the plating film 24B2 may be partially narrowed around the upper end thereof depending on a fabrication process of the plating film 24B2. The plating film 24B2 is a plating film of high aspect ratio (what is called HAP coil: high aspect plating coil), which is grown, as mentioned later, by using a film photoresist, so that the width thereof is thicker than that of the film photoresist.

The upper coil portions 24B can be fabricated by, for example, passing through the following fabrication procedure shown in FIGS. 19 through 22. FIGS. 19 through 22 describe a fabrication process of the upper coil portions 24B, extracting a part of the cross-sectional structures shown in FIG. 17.

Figure 19:
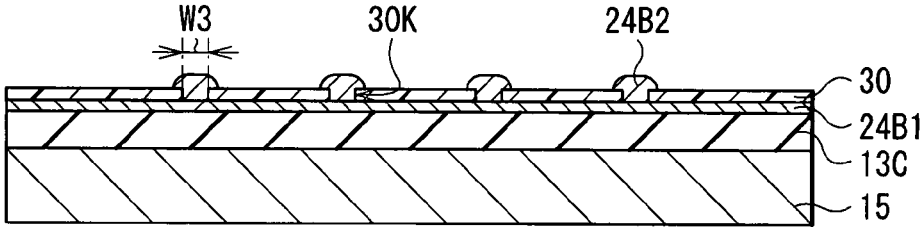
FIG. 19 is a sectional view for explaining a step of fabrication process of a thin film coil.

Upon fabricating the upper coil portions 24B, after forming the insulating film 13C so as to bury the middle magnetic film 15, firstly, the seed film 24B1 is formed so as to cover the upper insulating film 13C by electroless plating or sputtering as shown in FIG. 19. The seed film 24B1 may be made of the same material as that of the plating film 24B2, or may be different. Subsequently, after arranging a film photoresist 30 on the face of the seed film 24B1, a plurality of openings 30K are made therein by patterning the film photoresist 30 for selectively growing up the plating film 24B2 by photolithography. In this case, the opening width W3 of the opening 30K is made narrower than the width W1 (lower portion) of the plating film 24B2. Subsequently, the plating film 24B2 is selectively grown up in the openings 30K on the seed film 24B1 by electrolysis electroplating. In this manner, the plating reaction proceeds until the thickness of the plating film 24B2 becomes larger than that of the film photoresist 30 and partially extends onto the film photoresist 30 on the periphery of the opening 30K.

Figure 20:
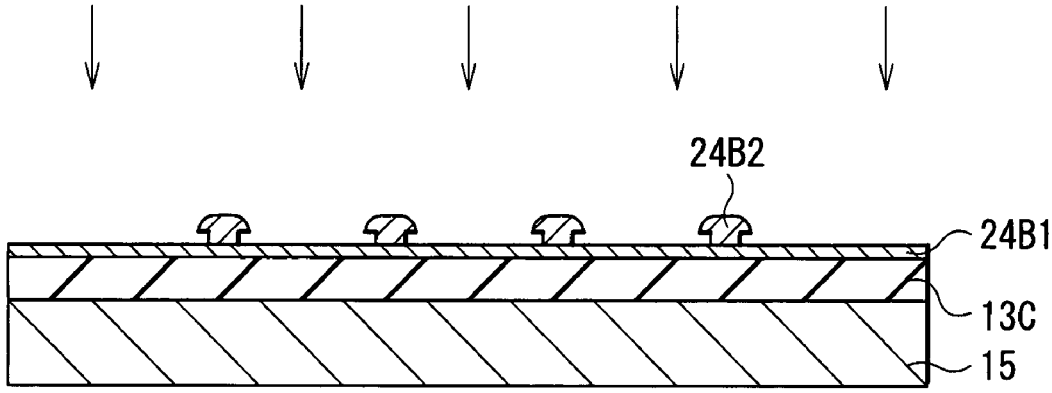
FIG. 20 is a sectional view for explaining a step subsequent to that of FIG. 19.
Figure 21:
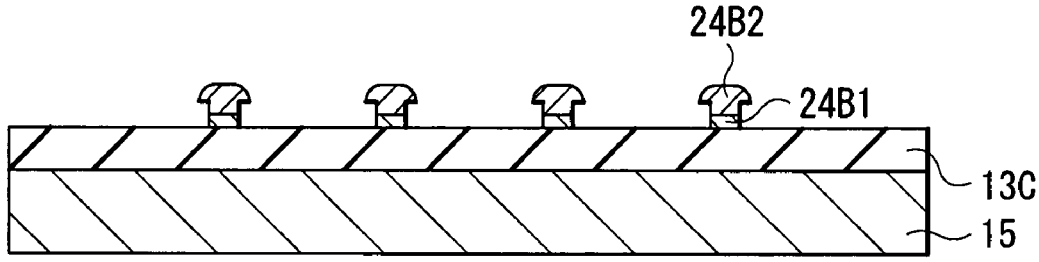
FIG. 21 is a sectional view for explaining a step subsequent to that of FIG. 20.

Subsequently, after removing the film photoresist 30, etching of the seed film 24B1 is carried out selectively by ion milling, wet etching, etc, with a mask of the plating film 24B2 as shown in FIG. 20, thereby removing the seed film 24B1 around the plating film 24B2 except under the plating film 24B2, as shown in FIG. 21.

Figure 22:
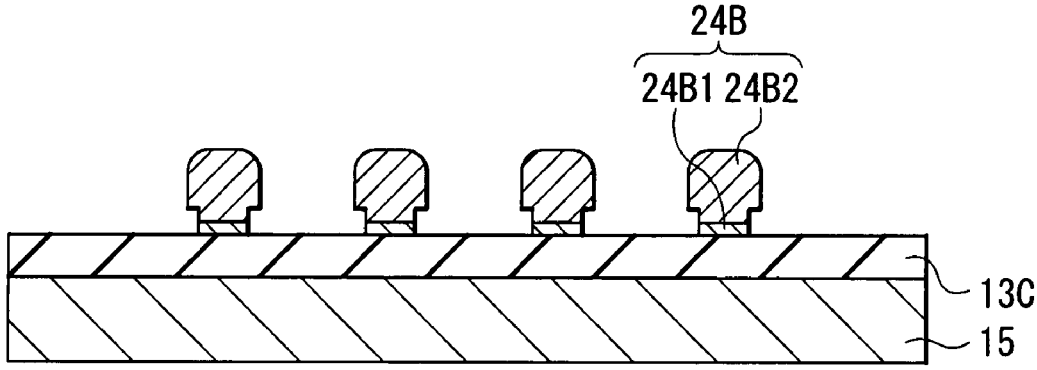
FIG. 22 is a sectional view for explaining a step subsequent to that of FIG. 21.

Finally, the plating film 24B2 is grown up further by electrolysis electroplating again. In the growing process of the plating film 24B2, growth rate in the film thickness direction is larger relative to that in the cross direction. Accordingly, the plating film 24B2 has grown for a short time so as to have a large aspect ratio (thickness/width) as shown in FIG. 22. In this case, since the seed film 24B1 also grows in the width direction in the progress course of the plating reaction to enlarge the width of the seed film 24B1, the width of the lower part of the plating film 24B2 is thereby enlarged similarly. Besides, there is a tendency that the growth rate of the plating film 24B2 in the film thickness direction is more delayed as going away from the central part to the side end thereof. Accordingly, the width of the plating film 24B2 narrows partially in the vicinity of the upper end. In such a manner, fabrication of the upper coil portions 24B including the seed film 24B1 and the plating film 24B2 is completed.

In a thin film device according to the present embodiment, since the upper coil portions 24B contains what is called a HAP coil (the plating film 24B2), the parasitic capacitance of each part which contributes to the whole parasitic capacitance is reduced as compared with the case of the comparative example shown in FIGS. 6 and 7. Specifically, firstly, between the coil turns of the upper coil portions 24B, since a distance between the lower parts thereof increases, the parasitic capacitance C1 is reduced. Secondly, even when the width W2 of the upper coil portions 24B (the plating film 24B2) is enlarged enough in order to reduce the direct current resistance of the thin film coil 24, the opposed area between the lower coil portions 24A and the upper coil portions 24B becomes small. As a result, the parasitic capacitance C2 is reduced. Thirdly, even when the width W2 is enlarged enough as described above, the opposed area between the thin film coil 24 and the middle magnetic film 15 becomes small. As a result, the parasitic capacitance C3 is reduced. Therefore, in the present embodiment, resonance frequency increases and the Q factor improves in a high frequency region because of the reduced whole parasitic capacitance even when the solenoid thin film coil 24 is provided. As a result, it is made possible to maintain desirable performance characteristics.

Especially, in the present embodiment, since the cross sectional area of the upper coil portions 24B becomes large because of high aspect ratio of the plating film 24B2 of the upper coil portions 24B, direct current resistance of the thin film coil 24 can be reduced.

The reduced direct current resistance of the thin film coil 24 based on the high aspect ratio of the plating film 24B2 has such an advantage as follows. That is, one cannot increase the aspect ratio of a thin film coil in order to reduce a direct current resistance thereof only by carrying out the usual plating process by use of a film photoresist, because a growth thickness of the plating film is restricted to below the thickness of the film photoresist. In this case, it is difficult to grow a thin film coil of a thickness of about 50 μm or more even if using two or more sheets of the film photoresists. To solve such a problem, according to the present embodiment, a plating film 24B2 can be formed by use of a sheet of film photoresist with a general thickness of about 50 μm or less, so that the thickness of the plating film 24B2 grows up to 50 μm or more, which is thicker than the film photoresist, through the fabrication procedures shown in FIGS. 19-22. As a result, the aspect ratio of the plating film 24B2 can become large enough. Therefore, the direct current resistance of the thin film coil 24 can be fully reduced even with use of the film photoresist.

Especially In this case, the plating film 24B2 of a high aspect ratio can be formed using a film photoresist, whose process cost is cheap. Therefore, as compared with a case of using a fluid photoresist of an expensive process cost, the upper coil portions 24B can be fabricated at low cost. The reasons why the process cost in using the fluid photoresist is expensive are as follows. (1) The photoresist itself is expensive. (2) Exchange of the plating liquid is required in carrying out spin coating or spray coating. (3) High viscosity is required in order to grow a thick plating film, and further, high sensitivity is required in order to expose the photoresist of a thick film by photolithography. (4) Management of the plating liquid is very difficult because it is easy to deteriorate when using a highly reactive photoresist in order to raise a sensitivity.

Further, according to the present embodiment, the surface smoothness of the middle magnetic film 15 improves more when the cross sectional height H of the lower coil portions 24A is smaller than that of the upper coil portions 24B, as compared with a case where the cross sectional height of the lower coil portions 24A is grater than that of the upper coil portions 24B as described above. As a result, inductance can be increased. Moreover, in the manufacturing process of the thin film inductor 20, it is not necessary to grind the lower coil insulating film 13B which works as a foundation thereof in order to improve the surface smoothness of the middle magnetic film 15, and the lower coil insulating film 13B can be easily embedded in a space between the coil turns of the lower coil portions 24A. Accordingly, the thin film inductor 20 can be manufactured easily. Especially in this case, as described above, plating rate becomes high by following the procedure explained with reference to FIGS. 19 to 22, and the plating film 24B2 of a high aspect ratio can be formed in a short time, thereby contributing to the simplification in manufacturing the thin film inductor 20.

Figure 23:
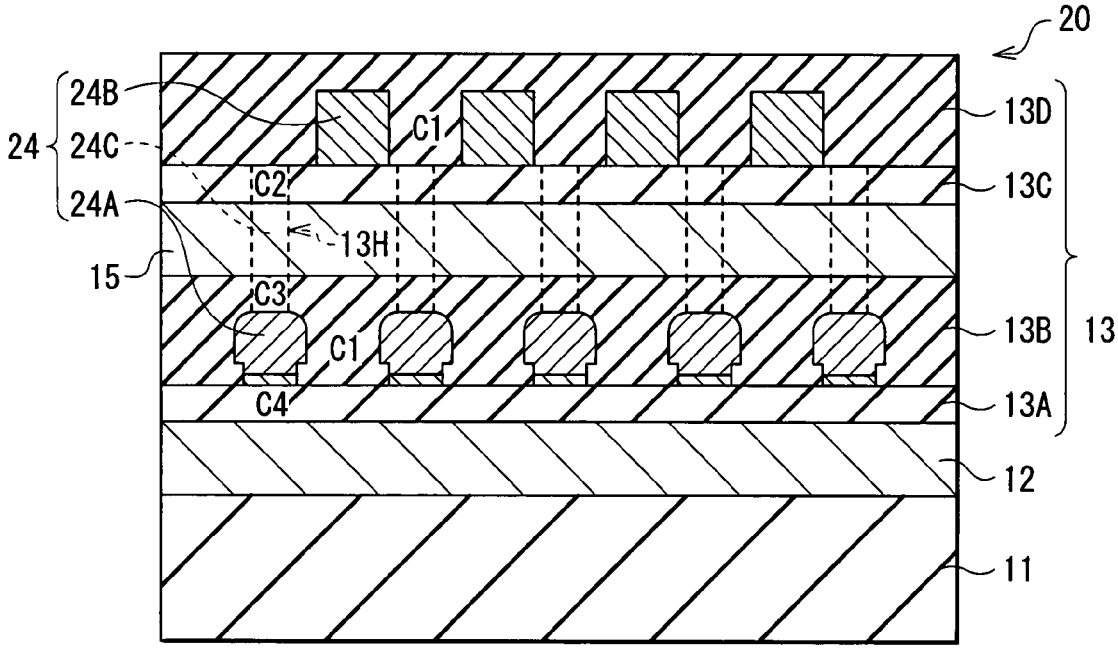
FIG. 23 is a sectional view showing a first modification with regard to a construction of the thin film inductor according to the second embodiment of the present invention.
Figure 24:
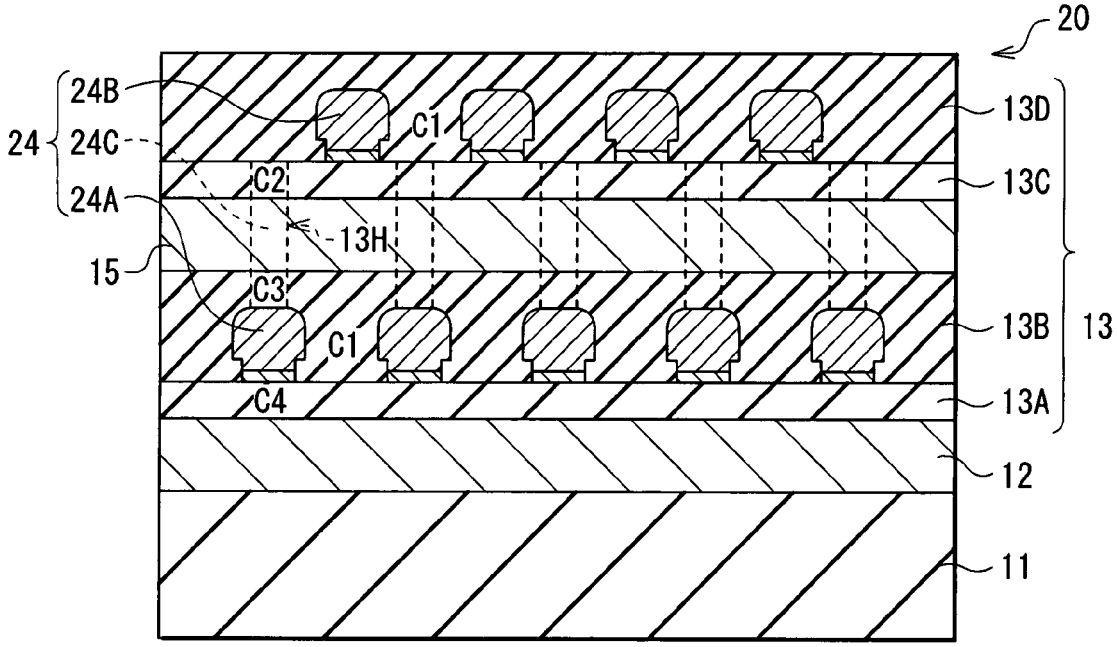
FIG. 24 is a sectional view showing a second modification with regard to a construction of the thin film inductor according to the second embodiment of the present invention.

Besides in the present embodiment, although the upper coil portions 24B include a HAP coil as shown in FIG. 17, it is not necessarily restricted to this. For example, as shown in FIGS. 23 and 24 corresponding to FIG. 17 respectively, the lower coil portions 24A may include the HAP coil instead of the upper coil portions 24B, (reference to FIG. 23), or both of the lower coil portions 24A and the upper coil portions 24B may include the HAP coil (reference to FIG. 24). In the cases shown in FIGS. 23 and 24, since the parasitic capacitances C1 through C4 may be reduced as compared with the case of the comparative example, the whole parasitic capacitance can be reduced and the Q factor can be improved in either case.

It is to be noted that the configuration, manufacturing method, operation, effect, and modification of the thin film device of the present embodiment are the same as that of the foregoing first embodiment except for the points described above. For confirmation, it is to be noted that, in the present embodiment, as well, whether or not the lower magnetic film 12 and the middle magnetic film 15 are provided therein can be determined arbitrarily as explained in the first embodiment with reference to FIGS. 14 to 16. That is to say, only one of the lower magnetic film 12 or the middle magnetic films 15 may be provided, or neither of them may be provided.

As mentioned above, the present invention has been described with reference to some embodiments, but the present invention is not limited to the above-mentioned embodiments, and various modifications are available. Specifically, although the case where the thin film device of the present invention is applied to a thin film inductor is described in each of the above-mentioned embodiments, for example, it is not necessarily restricted to this and may be applied to other devices than the thin film inductor. Examples of "the other devices" include a thin film transformer, a thin film magnetic sensor, MEMS (micro electro mechanical systems), or a filter or module including a thin film inductor, a thin film magnetic sensor, a thin film transformer or MEMS. Even when it is applied to the foregoing other devices, effects similar to that of each of the above-mentioned embodiments is obtainable.

Accordingly, the thin film device of the present invention can be applied to a thin film inductor, a thin film transformer or MEMS, or a filter or a module including those, for example.

Obviously many modifications and variations of the present invention are possible in the light of the above teachings. It is therefore to be understood than within the scope of the appended claims the invention may be practiced otherwise than as specifically described.

What is claimed is:

1. A thin film device comprising:

a thin film coil of a pipe-shaped solenoid coil, the thin film coil having a cross sectional width which varies with position along a film thickness direction; and a substrate supporting the thin film coil, the thin film coil including:

a plurality of first coil portions arranged in a layer closer to the substrate, a plurality of second coil portions arranged in a layer away from the substrate, and a plurality of third coil portions connecting the first and second coil portions so that the first, second and third coil portions are combined together in series to form the thin film coil, wherein the cross sectional width of at least one of the first and second coil portion is narrower at a part closer to the substrate rather than at a part away from the substrate.

2. A thin film device comprising:

a thin film coil of a pipe-shaped solenoid coil, the thin film coil having a cross sectional width which varies with position along a film thickness direction; and a substrate supporting the thin film coil, the thin film coil including:

a plurality of first coil portions arranged in a layer closer to the substrate, a plurality of second coil portions arranged in a layer away from the substrate, and a plurality of third coil portions connecting the first and second coil portions so that the first, second and third coil portions are combined together in series to form the thin film coil, wherein the cross sectional width of at least one of the first and second coil portion is narrowed at one end, facing the other coil portion, in the film thickness direction.

3. The thin film device according to claim 2, wherein the cross sectional width is narrowed at one end or both ends, in the film thickness direction, of a cross section of the thin film coil.

4. The thin film device according to claim 2, wherein one end or the other end in the longitudinal direction of the second coil portion is located so as to overlap with one end or the other end in the longitudinal direction of the first coil portion, and the third coil portions is arranged in a position where the second coil portion overlaps with the first coil portion.

5. The thin film device according to claim 2, further comprising:

at least one of a first, a second and a third magnetic film, the first magnetic film being wound with the thin film coil, the second magnetic film being arranged on a substrate-side of the thin film coil, and the third magnetic film being arranged on an opposite-side of the thin film coil from the substrate, wherein the cross sectional width is narrowed at one end, facing the first, second or third magnetic film, in the film thickness direction.

6. The thin film device according to claim 2, wherein the cross sectional width of at least one of the first and second coil portion is narrower at a part closer to the substrate rather than at a part away from the substrate.

7. The thin film device according to claim 6, wherein the cross sectional width of the first coil portion is uniform along a film thickness direction, and the cross sectional width of the second coil portion at a part closer to the substrate is narrower than that at a part away from the substrate, and is narrower than the cross sectional width of the first coil portion.

8. The thin film device according to claim 6, wherein the cross section of at least one of the first and second coil portion is mushroom-shaped.

9. The thin film device according to any of claim 6, further comprising at least one of a first and a second magnetic films, the first magnetic film being wound with the thin film coil, and the second magnetic film being arranged on a substrate-side of the thin film coil.

10. A thin film device comprising:

a thin film coil of a pipe-shaped solenoid coil, the thin film coil having a cross sectional width which varies with position along a film thickness direction;

a substrate supporting the thin film coil; and at least one of a first, a second and a third magnetic film, the first magnetic film being wound with the thin film coil, the second magnetic film being arranged on a substrate-side of the thin film coil, and the third magnetic film being arranged on an opposite-side of the thin film coil from the substrate, wherein the cross sectional width is narrowed at one end, facing the first, second or third magnetic film, in the film thickness direction.

11. The thin film device according to claim 10, the thin film coil including;

a plurality of first coil portions arranged in a layer closer to the substrate, a plurality of second coil portions arranged in a layer away from the substrate, and a plurality of third coil portions connecting the first and second coil portions so that the first, second and third coil portions are combined together in series to form the thin film coil, wherein the cross sectional width of at least one of the first and second coil portion is narrowed at one end, facing the other coil portion, in the film thickness direction.

* * * * *